United States Patent [19]

Matsuura

[11] 3,945,063

[45] Mar. 23, 1976

[54] BED AND STRETCHER FOR AN INVALID

[75] Inventor: Takashi Matsuura, Tokyo, Japan

[73] Assignees: Takashi Matsuura; Tamotsu Saito; Tetsuo Sato, all of Tokyo, Japan

[22] Filed: Dec. 9, 1974

[21] Appl. No.: 530,602

[30] Foreign Application Priority Data

Dec. 15, 1973 Japan ..... 48-141534

[52] U.S. Cl. ..... 5/63; 5/81 R

[51] Int. Cl.[2] ..... A47C 3/32

[58] Field of Search ..... 5/60, 61, 63, 81 R, 82, 5/86

[56] References Cited

UNITED STATES PATENTS

| | | | |
|---|---|---|---|
| 1,772,310 | 8/1930 | Hart | 5/61 |
| 2,614,266 | 10/1952 | Smith | 5/82 |
| 3,300,793 | 1/1967 | Thompson | 5/61 |
| 3,574,871 | 4/1971 | Greene | 5/81 R |
| 3,656,190 | 4/1972 | Regan | 5/60 |

*Primary Examiner*—Casmir A. Nunberg

*Attorney, Agent, or Firm*—Woodhams, Blanchard and Flynn

[57] ABSTRACT

A bed and a stretcher for permitting transferring of a patient from a stretcher over to a bed, or visa versa. The bed has a plurality of supporting ledges arranged in parallel with a uniform spacing and set in place on the main bed frame in a horizontal manner. A vertically traveling frame that has a plurality of uniformily spaced supporting ledges arranged in parallel in a horizontal manner is so set in place as to be movable in a vertical direction relative to the main bed frame, whereby the supporting ledges of the traveling frame are caused to be inserted into or pass through the spaces between the supporting ledges of the bed frame. The stretcher has a pair of spaced supporting bars and a supporting member for supporting a patient. One of the supporting bars is fixed on one end of the supporting member, and the other supporting bar is arranged to be connected with, and separated from, the other end of the supporting member. The stretcher and bed are combined with each other in such a manner that the supporting member of the stretcher is inserted into the spaces formed between respective adjoining supporting ledges of the vertically traveling frame.

8 Claims, 19 Drawing Figures

BED AND STRETCHER FOR AN INVALID

BACKGROUND OF THE INVENTION

The present invention relates to a bed and a stretcher for an invalid, specifically for a severely wounded person or a person taken seriously ill (hereinafter referred to as a patient), and the purpose of the present invention lies in providing such a bed and a stretcher whereby, at the time of transferring a the bed from a stretcher over to a bed, or from the over to the stretcher, the patient incurs no seriously adverse effect through the transfer, because of the body of the patient properly kept intact and free from torsion, impact, or any other harmful change of the posture.

It is imperative to exercise meticulous caution in the treatment of a person seriously wounded by a traffic accident, a plant disaster, or the like, or a person suffering from encephalopathy, for instance, cerebral apoplexy or the like, and a patient of this category has his or her wound or sickness exacerbated, and in case the worst comes to the worst, even loses his or her life quite often in case his or her posture is subjected to transfer by hands, impact, or any other change. The present invention makes it possible that, in the case of carrying a patient on a stretcher from a place of incurring a wound or sickness on the corresponding occasion and transferring the patient over to a bed, the patient can be safety transferred with a state of rest properly maintained, and that, in the case of transferring a patient from one bed to another bed as well, the state or rest of the patient can be properly maintained likewise.

DETAILED DESCRIPTION OF THE INVENTION

Figure 1:
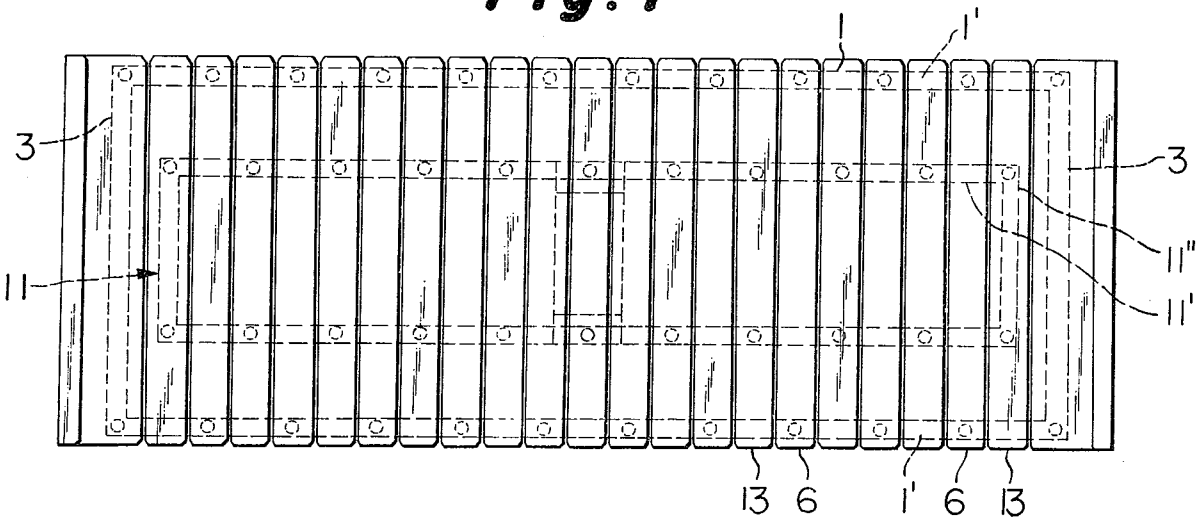
FIG. 1 is a plan of the bed introduced in the present invention.
Figure 2:
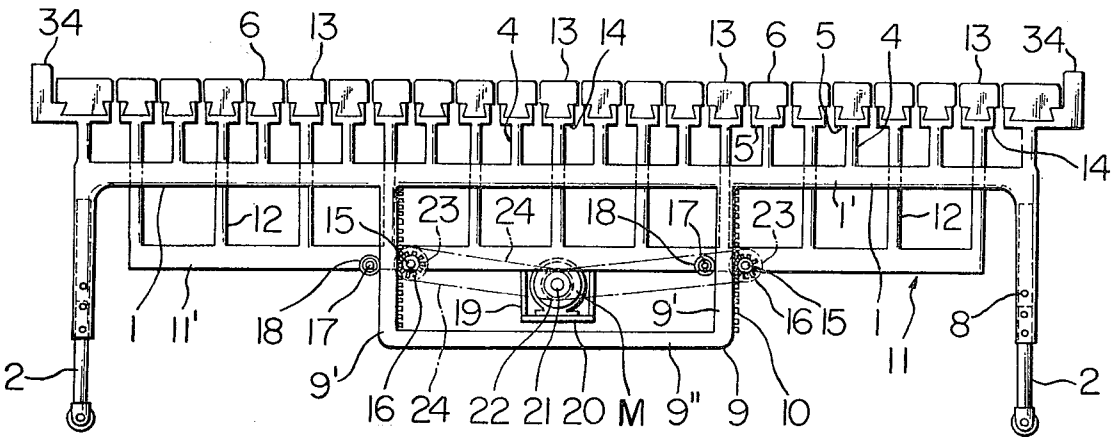
FIG. 2 is an elevation thereof.
Figure 3:
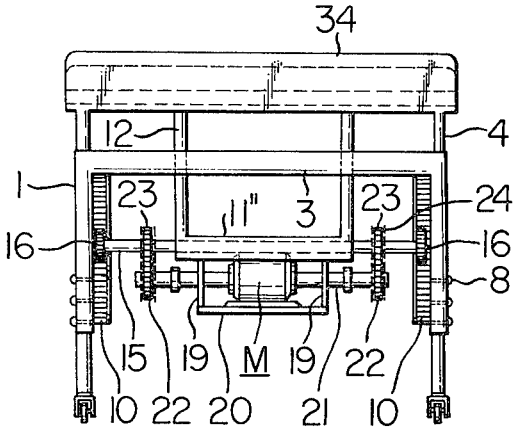
FIG. 3 is a side view thereof.
Figure 4A:
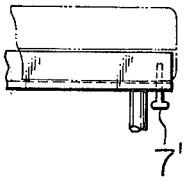
FIG. 4 is a drawing to show the fitting and the construction of the cushion of the bed.
Figure 4B:
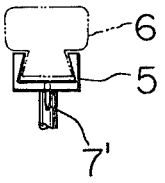
Figure 4C:
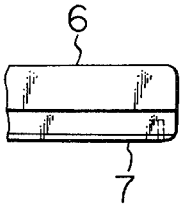
Figure 4D:
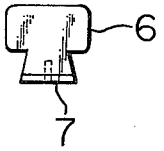
Figure 5A:
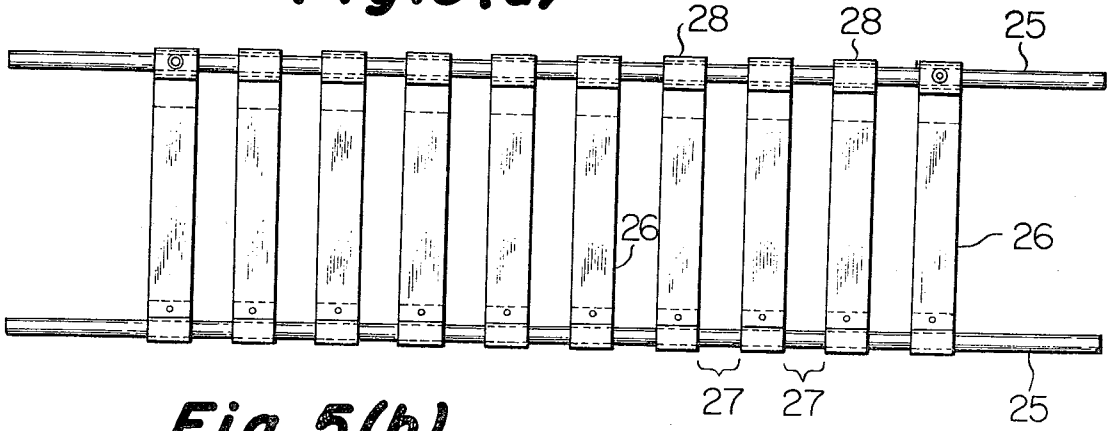
FIG. 5 is a drawing of the construction of the stretcher, Drawing (A) thereof being a plan, Drawing (B) and Drawing (C) thereof being side views, and Drawing (D) being a partial drawing to show the fitting and the construction of the canvas piece.
Figure 5B:
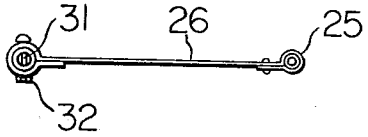
Figure 5C:
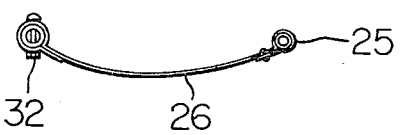
Figure 5D:
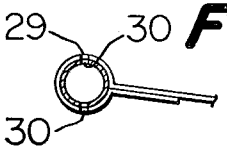

FIG. 1 through FIG. 3 show the bed introduced in one of the illustrations of the present invention, FIG. 1 being a plan of the bed, FIG. 2 being an elevation thereof, and FIG. 3 being a side view thereof, respectively.

In the drawings, 1 is the main frame of the bed, 2 is the leg of the bed, the main frame 1 comprises such a beam 1′ that extends horizontally on the both sides of the bed in the longitudinal direction of the bed and a beam 3 for connecting the front end and the rear end of the bed with each other, the beam 1′ has a plurality of struts 4 of equal height properly arranged thereon symmetrically at uniform spacings in an integral manner along the beam, and confronting struts on the said beam have a horizontal supporting ledge 5 properly arranged at the upper section thereof in an integrally incorporated manner with the strut 4, respectively. The said supporting ledge 5 has a bar-shaped cushion 6 properly fitted at the upper section thereof. The said cushion is desirably made of such an elastic substance like synthetic resin or the like, and the fitting thereof in place is conducted in such a manner that a dovetail protruding stripe is caused to be properly fitted into a dovetail-sectioned groove formed on the upper surface of the supporting ledge 5, for instance, in the longitudinal direction of the ledge in a manner of being fit therefor.

Thus, a plurality of the cushions 6 are arranged in parallel at uniform spacings, and the shape of a grate is properly formed.

The manner of fitting the cushions 6 on the supporting ledge 5 is as shown in FIG. 4. Each cushion 6 has a stiffening plate 7 properly fitted on the bottom thereof by either gluing or some other proper means, which cushion maintains its rigidity by virtue of the said stiffening plate 7, and is caused to be inserted into, and fitted on, the supporting ledge 5.

In FIG. 4, Drawing (*a*) and Drawing (*b*) show an elevation and a side view of a part of the supporting ledge, while Drawing (*c*) and Drawing (*d*) show an elevation and a side view of the end section of the cushion, wherein 7′ is a set-pin for the cushion screwed in place through the supporting ledge and the stiffening plate.

Each leg 2 of the bed is inserted into a pipe of the tubular leg constituting an integral entity with the main frame 1 at the front and the rear of the said main frame 1, and is fixed in place by a pin 8 in such a manner that the height thereof is made adjustable.

The beams 1′ on the both sides of the main frame 1 have a U-shaped frame 9 in an integrally incorporated manner hanging under the central portion thereof, and a couple of vertical members 9′ of the said frame have a rack 10 properly set in place on one side thereof (the right one shown in FIG. 2).

A vertically traveling frame 11 is so fitted in place as to be capable of traveling in the vertical directions along the main frame of the bed, as set forth in detail below. The said vertically traveling frame comprises a couple of beams 11′ arranged in parallel to the said beams 1′ of the main frame and a plurality of connecting beams 11″ for connecting the said beams 11′, the said beams 11′ have such struts 12 as are arranged upright in an integrally incorporated manner therewith and are properly set in place on the upper section thereof at uniform spacings, and the said struts have such supporting ledges 14 as have a plurality of cushions 13 fitted on the top surface thereof properly arranged on the upper section thereof in the same manner as in the case of the struts 5 of the main frame of the bed.

In terms of the dimension, the struts 12 are fairly longer than the struts 4.

The beams 11′ have a couple of shafts 15 properly arranged in place at the center of the span thereof in a manner of running through the both of the beams on the right and the left thereof, and the both ends of the said shafts have a pinion 16 properly fixed thereon, respectively.

Furthermore, the said beams 11′ have a couple of shafts 17 properly fixed on the center thereof in parallel to the said shafts 15 and at uniform spacings in the horizontal directions of the said shafts 15, and the said shafts 17 have a roller 18 properly fitted in place at the both ends of the said shafts 17.

And, the said pinion 16 is engaged with the said rack 10, and holds the vertical frame 9′ of the vertically traveling frame between the said roller 18 and the said pinion 16 from the both sides.

M represents an electric motor, which is set in place on a horizontal plate 20 suspended by struts 19 down from the beams 11' at the center of the span of the said beams.

21 represents such a driving shaft as is driven and put in revolution by virtue of the said electric motor M, and is subjected to decelerated drive through a reduction gear (not shown in the drawing).

The driving shaft 21 has a sprocket 22 properly fixed in place on the both ends thereof, the said shaft 15 has a sprocket 23 properly fixed thereon, and a chain 24 is properly set in place between the sprockets 22, 23.

Besides, as elucidated through FIG. 2, in such a state wherein the cushion 6 on the supporting ledge of the main frame 1 and the cushion 13 on the supporting ledge of the vertically traveling frame 11 are inserted alternately into the clearance thereof to be thus supported on the same level, the top surface of the cushions are on the same horizontal plane, and the top surface thereof constitutes the top surface of the bed.

In case the electric motor M stops its revolution, and the driving shaft 21 is in a braked state, the chain 24 remains in a stationary state with the tension thereof kept intact, and the pinion 16 is not allowed to be put in revolution; therefore, the vertically traveling frame 11 is kept in a stopped state, without traveling along the main frame 1.

Shown in FIG. 5 is an illustration of the stretcher for carrying a patient over to the bed. In FIG. 5, notations 25, 25 show supporting bars for carrying the stretcher, and a plurality of canvas pieces 26 are stretched in a tensile manner between the couple of supporting bars to thus constitute a supporting member to place a human body thereon. The canvas pieces 26 are belt-shaped, and said pieces are arranged parallel at uniform spacings 27. One end of each canvas piece 26 is wound and fixed on one of the said supporting bars 25, meanwhile the other end is given a tubular form by sewing or other proper means, in such a manner that one supporting bar can be put into the tubular section and pulled off position therefrom at liberty.

And, of all the belt-shaped canvas pieces, those arranged at the front end and the rear end have a tiny hole 29 properly formed on the upper and lower sides of the said tubular section; besides, the supporting bars (tubular bars) have through-holes 30 properly drilled at such positions thereof as are corresponding to the said tiny holes formed through the end sections of the canvas pieces (see Drawing (D)), and pins 31 are inserted in place through the said tiny holes 29 and the said through-holes 30 as well, whereby the said canvas pieces are fixed in place on the supporting bar by the employment of bolts and nuts 32.

Next, given below will be a description of the workability and the handling of the bed and the stretcher introduced in the present invention.

Figures 6A, 6B:
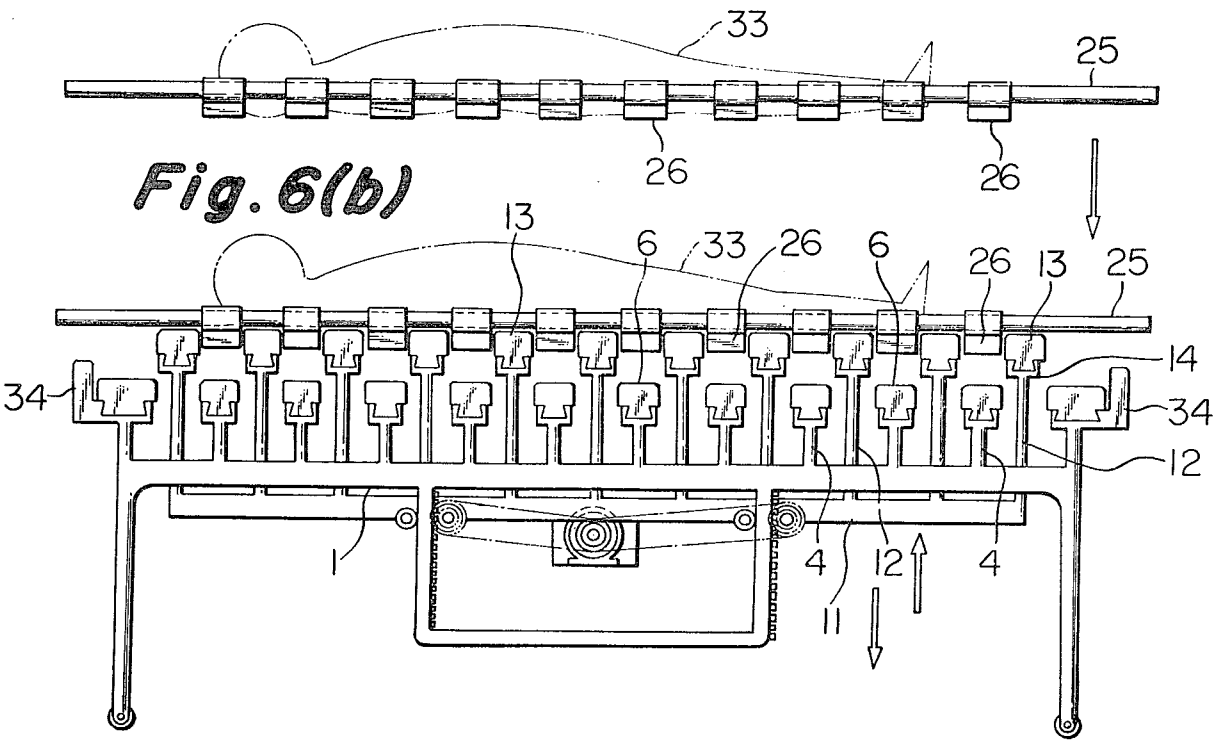
FIG. 6 is an elevation to show the mode of use of the bed and the stretcher.

Shown in FIG. 6 are the workability and the handling of the bed and the stretcher, wherein Drawing (A) is a front view of the stretcher, 33 designating by dotted lines a patient laid on the back thereon; and Drawing (B) is a front view showing the state of the bed at the time of transferring a patient from the stretcher over to the bed, in more specific terms, the state wherein the transfer is going to start.

Now, in case the driving motor M is put in operation, whereby the pinion 16 is caused to revolve in the counterclockwise direction, in the state shown in FIG. 2, the pinion 16 rises upward in the state of being engaged with the rack 10, since the said rack engaged with the said pinion is incorporated with the vertical frame 9' and fixed on the main frame 1 of the bed.

Therefore, the vertically traveling frame 11 is caused to rise upward, and the cushions 13 set in place on the supporting ledges fixed and supported on the vertically traveling frame 11, as shown in FIG. 6 (B), move upward above the cushions 6 set in place on the supporting ledges supported by the main frame. When the cushions 13 reach the proper height, the electric motor M is caused to stop, and the cushions 13 are then caused to stop at the position whereto such have risen up. A patient having been carried on the stretcher is laid on the bed in a soft and gentle manner, in this state, with the body of the patient kept held intact on the stretcher, in such a manner that the belt-shaped canvas pieces 26 are just properly and squarely fitted into the clearance between the cushions 13. (In this case, it is advisable that the width of each canvas piece 26 be such that can be inserted at liberty into the clearance of the cushions 13.)

Now that the width of the stretcher is so selected as to be less than the width of the bed, the supporting bars 25 of the stretcher are properly supported on the cushions 13 of the bed, and the canvas pieces fall downward in the clearance of the cushions 13, whereby the patient having been supported thereon can be then properly supported on the cushions 13.

Figure 7:
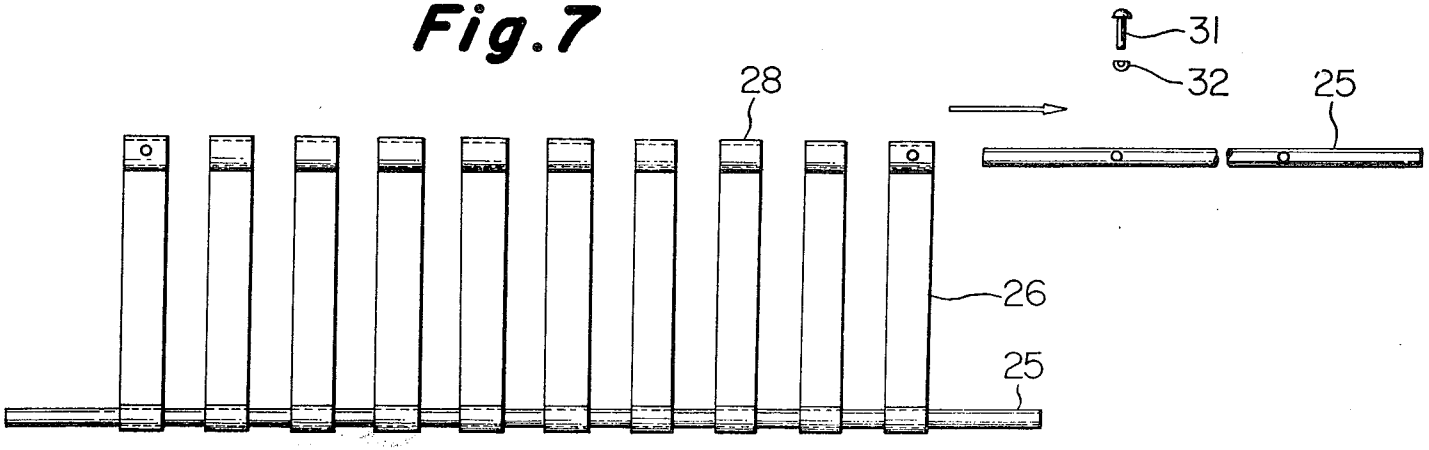
FIG. 7 is a plan to show the mode of use of the stretcher.

In the wake thereof, when the pins 31 for fixing the canvas pieces on the both ends of the stretcher are pulled position, and one of the supporting bars 25 is then pulled off from the tubular section for the canvas pieces, now one end of the canvas pieces is set free and falls on the cushion pieces 6. Next, when the other supporting bar 25 is caused to move in the sideward direction of the bed, the stretcher can be taken off from the bed. Shown in FIG. 7 is a plan depicting such a state wherein one of the supporting bars 25 is just pulled from the canvas pieces.

Thus, in case the electric motor M is driven, after the patient is perfectly supported on the cushion pieces of the vertically traveling frame 11 of the bed, then the vertically traveling frame is caused to descend downward in a manner contrary to what is set forth above, and properly stopped with the top surface of the cushion pieces 13 and that of the cushion pieces 6 set on the same level, whereby the patient can be properly and perfectly supported on the bed.

In the case of transferring the patient from on the bed over to the stretcher, contrary to what is set forth above, the vertically traveling frame 11 descends in relation to the main frame of the bed, when the electric motor M is put in revolution in the direction opposite to that in the case set forth above from the state shown in FIG. 2. In the case the vertically traveling frame is caused to stop at a proper position in the course of its descent, whereby the cushions 13 stop at a position below the cushions 6, and the patient is kept supported intact on the cushions 6.

In the case, when one of the supporting bars of the said stretcher is pulled out of the canvas strips, the other one of the supporting bars is put directly on the cushions 6, and the belt-shaped canvas pieces are conformed with the clearance of the cushions 6, and caused to be set in the said clearance between the top surface of the said cushions 13 having descended and the patient, and the said one supporting bar is inserted into the tubular section on the other end of the canvas pieces, then the both ends of the canvas pieces are fixed on the supporting bars.

Now that the stretcher is set in the state well prepared for having the patient laid thereon with his or her body kept supported intact on the bed, the patient can be laid on the stretcher in a proper manner by merely raising the stretcher intact, and can thus be carried wherever desired.

As elucidated in details above, the present invention makes it practicable to transfer a patient in the lying posture form on the bed over to the stretcher completely free from touching the body of the patient with man's hands at all, and from on the stretcher over to the bed.

Shown in FIG. 8 through FIG. 11 is another illustration of the stretcher.

In the drawings, 36 is the supporting bar, 37 is a handle for grasping the said supporting bar, 44 is a spring for elastically tying the said handle to be supporting bars, and a series of bar-shaped cushions 39 are properly arranged between the supporting bars at uniform spacings for constituting a supporting member for a patient, in such a manner as is set forth below.

The bar-shaped cushions 39 as a supporting member for supporting a patient thereon are respectively divided and fixed in place on such concave U-shaped supporting plates 40, 40' as are connected with each other by a hinge 41 at the center thereof. One of the supporting plates, 40, is fixed in place on such an L-shaped supporting arm 38 as is fixed in place on one supporting bar 36; meanwhile, the cushions 39 fixed in place on the other supporting plate 40' hinged on the supporting plate 40 have a through-hole 43 formed in the longitudinal direction, and the said through-hole 43 runs in such a manner as to be connected with an opening formed through the side plate of the supporting plate 40'.

The other supporting bar 36 has many L-shaped supporting arms 38' properly fixed thereon, and the horizontal leg of the arm 38' is long enough to be is inserted into the opening of the said supporting plate and the throughhole 43 of each cushion, thus properly constituting the stretcher.

42 is a tubular socket threaded in place on the said supporting arm 38', which arm has a thread properly cut on the outer circumference, and the supporting arm 38' and the supporting plate 40' are properly fixed in place by screwing the said socket in place into the bent piece of the supporting plate from outside.

Figure 8:
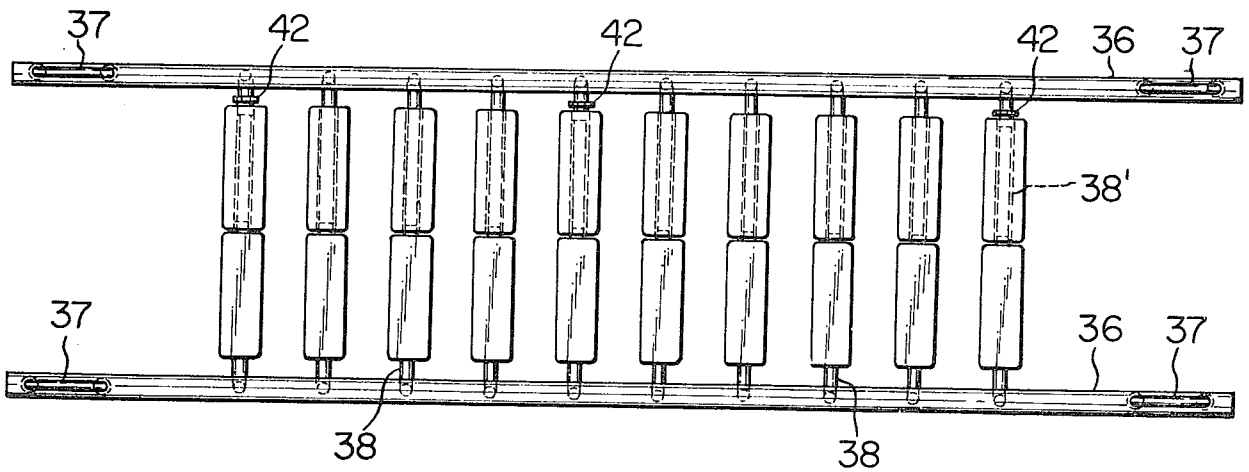
FIG. 8 through FIG. 11 are a plan, an elevation, and side views, to show other illustration of the stretcher.
Figure 9:
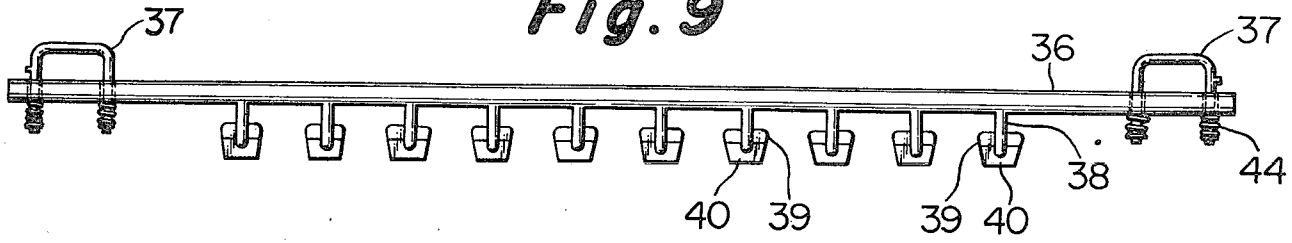
Figure 10:
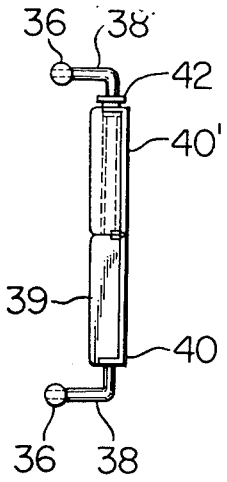
Figure 11A:
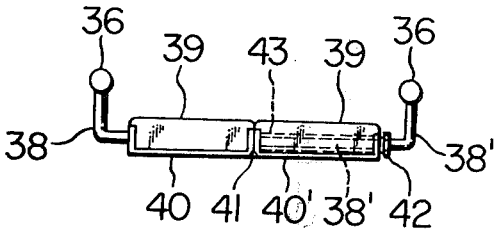
Figure 11B:
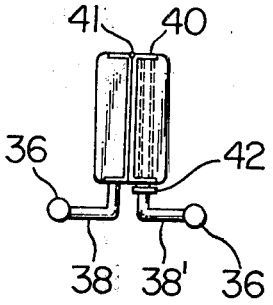

And, in case the stretcher is put in use for the practical purpose, the cushions are developed into a planar shape in such a manner as shown in FIG. 8 and FIG. 11 (A); meanwhile, in case the stretcher is not in use, the cushions are folded at the center thereof as shown in FIG. 11 (B), prior to keeping the same in custody.

In case a patient is transferred from the said stretcher over to the bed, or in case the patient is transferred from the bed over to the stretcher, the cushions of the bed and the cushions of the stretcher can be used in such a manner that both are interfitted within each other, just as in the case of the stretcher made of the said canvas pieces.

In the case of this stretcher, separation or combination of one of the supporting bars can be facilitated by screwing the socket into, or off, the supporting plate; furthermore, now that the cushions of the stretcher are bar-shaped, the stretcher can be incorporated with the bed more easily than in the case of the stretcher made of canvas pieces, in the case of transferring a patient from the bed over to the stretcher.

Furthermore, with regard to the mechanism for causing the vertically traveling of the frame 11 some other adequate mechanism may well be selected as a substitute therefor.

Thus, the bed and the stretcher introduced in the present invention make it possible to transfer a patient from the stretcher over to the bed, and vice versa, completely free from touching the patient with man's hands at all, to put it otherwise, without subjecting the position of the body or the posture of the patient to any change whatsoever, only excepting the case of placing the patient on the stretcher, as set forth above.

In case a seriously wounded person or a person taken seriously ill is laid on a bed, the top surface of the bed is often stained with blood and/or filth. In the case of the bed introduced in the present invention, now that each and every one of the bar-shaped cushions can have a bed cover sheet properly employed as a sack-shaped cover thereof, and the cushion 13 can be raised above the cushion 6 in such a manner as set forth above, a patient is raised upward with his or her body kept laid intact on the bed, and while the patient is thus kept raised upward, such a bed cover sheet of the cushion 6 as is stained with blood or the like can be properly replaced with a clean one.

Likewise, in case the cushion 13 is caused to descend below the cushion 6, the bed cover sheet of the cushion 13 can be replaced with a clean one in the same manner.

In case no cover sheet is employed for the cushions unlike the case set forth above, such bar-shaped cushions as are stained with blood or the like can be replaced with clean ones in the same manner as set forth above.

In the conventional practice generally followed in hospitals, a bed cover sheet stained with blood or filth of a patient is replaced with a clean one by moving the body of the patient as an unavoidable process, which has often involved grave difficulty, especially in the case of a seriously wounded person or a person taken seriously ill, until the condition of the patient is often seriously affected thereby.

Meanwhile, in case the bed introduced in the present invention is employed, a bed cover sheet or the cushions of a bed can be properly and favorably replaced with a clean one or clean ones, while a patient remains lying intact on the bed, thus proving quite effective and efficient.

What is set forth above is a description relating mainly to the bed; however, it goes without saying that what is introduced in the present invention, including the bed, the stretcher, and/or the combinations thereof, is well available and can be utilized as an operating table, as far as the same is provided with a vertically traveling frame, as well as such a main frame as has supporting ledges, or supporting ledges coupled with a series of cushions, for supporting a patient, in the like manner as in the case of the bed introduced above.

What is claimed is:

1. A bed for an invalid, comprising:

a main frame;

first means fixed with respect to said main frame and defining a first, substantially horizontal, upwardly facing support surface for supporting an invalid thereon;

said first means including a plurality of elongated support members disposed in parallel relationship, said support members extending transversely across the bed and being uniformly spaced apart by a preselected distance in the longitudinal direction of the bed, whereby each adjacent pair of support members has a preselected space therebetween;

each of said support members having an upper surface area which defines a part of said first support surface;

a travelling frame movably supported on said main frame for vertical movement relative thereto;

second means mounted on said travelling frame and defining a second, substantially horizontal, upwardly facing support surface;

said second means including a plurality of elongated supporting elements disposed in parallel relationship, said supporting elements extending transversely across the bed and being uniformly spaced apart by a predetermined distance in the longitudinal direction of the bed, whereby each adjacent pair of supporting elements has a predetermined space therebetween, said supporting elements being vertically aligned with and adapted to fit within the preselected spaces formed between the adjacent support members, and the centerline-to-centerline spacing between adjacent supporting elements being substantially equal to the centerline-to-centerline spacing between adjacent support members;

each of said supporting elements having an upper surface area which defines a part of said second support surface; and drive means connected to said travelling frame for vertically moving same between a first position wherein the supporting elements are disposed within the preselected spaces defined between the adjacent support members so that the upper surface areas of the supporting elements and support members define a common horizontal support surface for an invalid, and a second position wherein the support members and supporting elements are vertically spaced apart so that only one of said first and second support surfaces is usable as an invalid supporting surface.

2. A bed according to claim 1, wherein said supporting elements are disposed vertically below said support members when in said second position, and said drive means also moving said travelling frame into a third position wherein said supporting elements are disposed vertically above said support members.

3. A bed according to claim 1, wherein each of said elongated support members and supporting elements includes an elongated cushion adapted for engagement by an invalid.

4. A bed according to claim 1, wherein said drive means includes electric motor means mounted on said travelling frame and drive reaction means coacting between said motor means and said main frame for causing vertical displacement of said travelling frame when said motor means is energized.

5. In combination with a bed according to claim 1, a stretcher adapted for cooperation with the bed for permitting the transfer of an invalid therebetween, said stretcher comprising:

a pair of spaced, elongated, substantially parallel supporting bars;

patient supporting means mounted on and extending between said supporting bars for supporting a patient or invalid thereon;

said patient supportinng means including a plurality of patient engaging members disposed in parallel relationship and extending transversely between said supporting bars so that opposite ends of said engaging members are mounted on said bars, said engaging members being uniformly spaced apart in the longitudinal direction of the stretcher whereby each adjacent pair of engaging members has a selected distance therebetween;

said engaging members having a width no greater than the width of said spaces, and said engaging members having a centerline-to-centerline spacing between adjacent engaging members which is substantially equal to the centerline-to-centerline spacing between adjacent support members, whereby said engaging members can be disposed within the spaces formed in the bed when said travelling frame is in said second position, thereby permitting transfer of a patient between said stretcher and one of said first and second supporting surfaces.

6. The combination according to claim 5, further including connecting means coacting between one of said supporting bars and the adjacent ends of said engaging members for permitting said one supporting bar to be separated from the remainder of the stretcher.

7. The combination according to claim 6, wherein each said engaging member comprises a flexible beltlike strip extending between and connected to said supporting bars, one end of said beltlike strip being slidably coupled to said one supporting bar so that said one said supporting bar can be slidably disconnected from the beltlike strips.

8. The combination according to claim 6, wherein each of said engaging members comprises first and second portions disposed in substantial alignment with one another and having their adjacent ends hingedly connected together, the other ends of said portions being respectively connected to one of the supporting bars.

* * * * *